United States Patent [19]

Focke et al.

[11] Patent Number: 4,936,440

[45] Date of Patent: Jun. 26, 1990

[54] APPARATUS FOR TRANSPORTING CIGARETTE PACKS IN CONJUNCTION WITH A PACKAGING MACHINE

[75] Inventors: Heinz Focke; Helmut Granz, both of Verden, Fed. Rep. of Germany

[73] Assignee: Focke & Co., Verden, Fed. Rep. of Germany

[21] Appl. No.: 269,332

[22] Filed: Nov. 10, 1988

[30] Foreign Application Priority Data

Nov. 21, 1987 [DE] Fed. Rep. of Germany ..... 3739551

[51] Int. Cl.[5] ..... B65G 47/26

[52] U.S. Cl. ..... 198/427; 198/433; 198/441; 198/450; 198/470.1; 53/202; 53/234

[58] Field of Search ..... 198/427, 433, 441, 450, 198/470.1, 803.9; 53/202, 234

[56] References Cited

U.S. PATENT DOCUMENTS 4,084,393 4/1978 Focke .

4,150,520 4/1979 Palmieri et al. ..... 198/450

4,382,422 5/1983 Eddy et al. ..... 198/470.1

FOREIGN PATENT DOCUMENTS 2462974 8/1984 Fed. Rep. of Germany .

*Primary Examiner*—Joseph E. Valenza

*Attorney, Agent, or Firm*—Sughrue, Mion, Zinn, MacPeak & Seas

[57] ABSTRACT

For transferring cuboid (cigarette) packs (10, 11) from a (rectilinear) pack track (12) to a drying turret (13) or the like, there is a transfer turret (17) which is designed for the reception, further transport and transfer of two packs (10, 11) at a time simultaneously. For this purpose, pocket units (20, 21, etc.) with two pockets (**18, 19; 18*a*, 19*a*, etc.) arranged next to one another and fed simultaneously are mounted on the transfer turret (17). Their pocket walls (outer walls 29, 30 and inner walls 31, 32) are actuated for opening and closing via main levers (36, 37) and supporting levers (38, 39), these being supported on a rotatable cam disc (42, 43**).

14 Claims, 4 Drawing Sheets

APPARATUS FOR TRANSPORTING CIGARETTE PACKS IN CONJUNCTION WITH A PACKAGING MACHINE

BACKGROUND OF THE INVENTION

The invention relates to an apparatus for transporting block-shaped (cigarette) packs, especially for transferring these from a conveying track to a (drying) turret, with a transfer turret which has a number of radially outwardly and laterally open pockets for receiving the packs, the pockets possessing transversely moveable, especially pivotable pocket walls which, for the reception and discharge of packs, can be moved away from one another as a result of the supporting of pivoting levers of the pocket walls on a cam disc moveable to and fro.

A transfer apparatus of this type for cigarette packs was described previously in German Offenlegungsschrift No. 2,440,006. The transfer turret shown there serves for receiving cigarette packs from a rectilinear feed track to a drying turret (FIG. 13) of German Offenlegungsschrift 2,440,006 (which corresponds to U.S. Pat. No. 4,084,393 - Focke). The transfer turret is equipped with pockets which are intended and designed for receiving two packs arranged next to one another in the radial direction. These are introduced, in the radial direction, into the open pockets, having pocket walls moved away from one another, and are pushed axially out of the pockets and into pockets of the drying turret. The apparatus designed in this way for the transfer of packs to a drying turret does not guarantee a sufficiently reliable transport of the two packs at a time arranged in a pocket.

SUMMARY OF THE INVENTION

The object on which the invention is based is to develop further and improve an apparatus for transporting (cigarette) packs, to the effect that the transfer turret makes it possible to achieve a higher output, whilst at the same time ensuring a reliable transport of the packs.

To achieve this object, the apparatus according to the invention is characterized in that, in order to receive, convey and transfer two packs simultaneously, the transfer turret has two pockets which are arranged next to one another in one plane and the pocket walls of which are moveable simultaneously into the opening or closing position by means of pairs of pivoting levers.

The pockets are each designed for receiving a single pack. The two pockets arranged next to one another are each fed simultaneously (from below) with one pack. These packs are likewise transferred simultaneously to pockets of a drying turret or of another conveying member by being pushed out radially.

Pocket walls grasping the packs on side faces are each connected to a pivotable actuating lever, in particular outer walls to a main lever and inner walls to a supporting lever, the main levers being supported by means of a tracer roller on the circumference of a cam disc and the supporting levers being supported by means of a supporting roller on the main lever or its tracer roller.

For the sake of accommodation in space, the main and supporting levers of the same pocket are arranged in a common plane, offset relative to the main and supporting levers of the adjacent pockets. A main lever and a supporting lever, respectively, of another adjacent respective pocket are mounted on the common rotary axle. These are arranged, in turn, between two turret discs located at a distance from one another, so as to connect these to one another.

As a result of simple functional sequences, the transfer turret according to the invention makes it possible to ensure a reliable actuation of the pockets, in such a way that two particular packs can be introduced into downwardly pointing open pockets in the region of a receiving station and transferred to the drying turret in the axial direction in the region of a transfer station, the pocket walls being opened wide in the region of the receiving station, but being opened only slightly in the region of the transfer station.

Further features of the invention relate to the design of the transfer turret.

An exemplary embodiment of the invention is explained in detail below with reference to the drawings, in which:

DETAILED DESCRIPTION OF A PREFERRED EMBODIMENT

Figure 1:
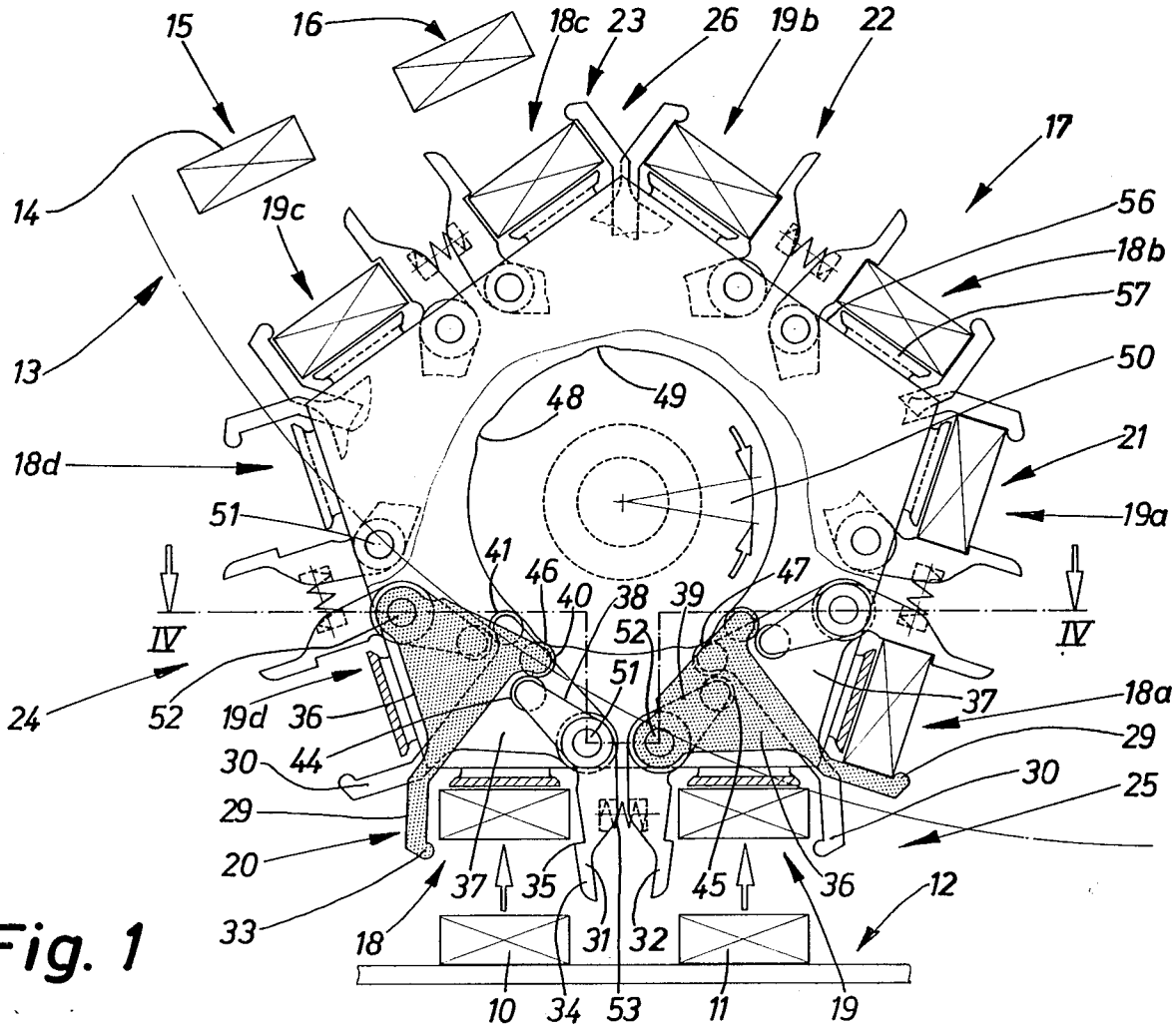
FIG. 1 shows a partially sectional front view of the transfer apparatus with a transfer turret.

The apparatus illustrated is part of the packaging machine, especially for (cigarette) packs 10, 11 of the hingelid type. An example of the remaining part of the packaging machine is illustrated and described in German Offenlegungsschrift No. 2,440,006. The apparatus shown is arranged after a pack track 12 for the rectilinear transport of the finished packs 10, 11. After the folding operations have been concluded, the packs 10, 11 are to be transferred to a drying turret 13, in which the packs 10, 11 dwell in order to stabilize their shape and dry out glue spots. A drying turret 13 is accordingly equipped with a plurality of drying pockets 4 arranged along the circumference and each intended for receiving a pack 10, 11.

In the apparatus illustrated, two packs 10, 11 produced simultaneously and conveyed next to one another on the pack track 12 are to be appropriately conveyed further and transferred simultaneously to the drying turret 13. This is equipped with two pocket rings 15, 16 consisting of a series of drying pockets 14 arranged closely next to one another. Two drying pockets 14 located next to one another in the radial direction are fed simultaneously with packs 10, 11.

The two packs 10, 11 are transferred from the pack track 12 to the drying turret 13 by means of a transfer turret 17. This is equipped along the circumference with several pairs of pockets **18, 19, 18*a*, 19*a*, etc. arranged next to one another. Every two pockets 18, 19, etc. lie next to one another, aligned in a common plane, and form a pocket unit 20, 21, 22, 23, 24. Five pocket units 20 to 24, each with two pockets 18, 19; 18*a*, 18*b***, etc., are therefore arranged next to one another in the circumferential direction in the manner of a polygon. The transfer turret 17 thereby acquires as a whole the form of a regular pentagon.

The pockets 18, 19; 18*a*, 18*b*, etc. are designed so that, in a lower position in the region of a receiving station 25, the two packs 10, 11 can be introduced from the pack track 12 upwards into the pockets 18, 19, etc. in an approximately radially directed movement. The transfer of the packs 10, 11 from the pack track 12 to the transfer turret 17 can take place in a similar way to German Offenlegungsschrift No. 2,440,006 (FIGS. 12 and 13 of this specification). Thereafter, with the pockets 18, 19, etc. closed, the transfer turret 17 is advanced over an angular sector corresponding to a pocket unit 20, 21, etc., in the anti-clockwise direction in the exemplary embodiment of FIG. 1. The packs 10, 11 are thus conveyed by the transfer turret 17 into the region of a transfer station 26. Here, with the pockets 18, 19, etc. opened slightly, the packs 10, 11 are pushed out in an axis-parallel direction into the drying pockets 14 of the two pocket rings 15 and 16 which are aligned with the pockets 18, 19, etc. during the transfer. For transferring the packs 10, 11 to the drying turret 13, appropriate slides 27, 28 moveable to and fro are assigned to the pockets 18, 19, etc. in the transfer station 26.

Figure 2:
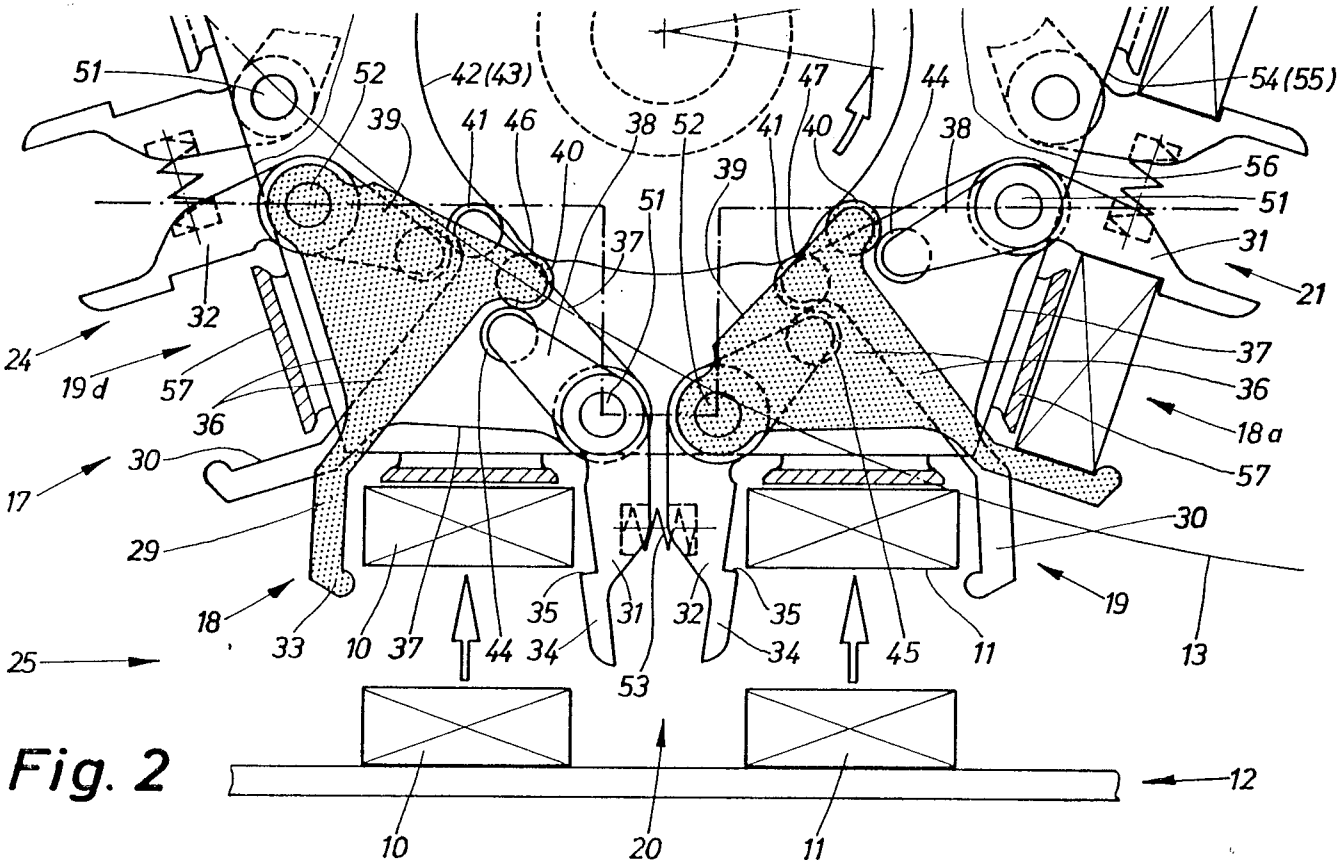
FIG. 2 shows a cutout from the transfer turret in a representation corresponding to that of FIG. 1 and on an enlarged scale.

The pockets 18, 19; 18*a*, 19*a*, etc. each consist of two pocket walls, in particular an outer wall 29, 30 and an inner wall 31, 32. These are shaped so that they keep the packs 10, 11 in the closed position, but on the other hand also make it possible for them to be introduced into the pockets 18, 19, etc. For this purpose, the outer walls 29, 30 which are shorter in the radial direction are equipped, at the outer edges, with an angled retaining edge 33. The inner walls 31, 32 have an extension piece 34 which, when the pockets 18, 19 are open (FIGS. 1 and 2 at the bottom) assumes a funnel-shaped position and thereby makes it easier to introduce the packs 10, 11 into the pockets 18, 19 in the radial direction. An offset 35 forms a stop for retaining the pack 10, 11 in the pocket.

The outer walls 29, 30 and inner walls 31, 32 are mounted on pivotable actuating levers. The outer walls 29, 30 are connected respectively to main levers 36, 37. The inner walls 31, 32 rest on supporting levers 38, 39. The abovementioned levers 36 to 39 are designed as two-armed levers. Located on the free ends of the main levers are tracer rollers 40, 41. These run on the circumference of cam discs, in the present exemplary embodiment two identically designed cam discs 42, 43 arranged next to one another. The two cam discs 42, 43 are provided because, as a result of the arrangement of the levers in different planes, the tracer rollers 40, 41 are offset relative to one another.

The supporting levers 38, 39 are stressed with a pivoting effect by the main levers 36, 37, specifically because supporting rollers 44, 45 rest against tracer rollers 40, 41 of associated main levers 36, 37. The relative position of the tracer rollers 40, 41 in relation to the supporting rollers 44, 45 is such that a movement of the tracer rollers 40, 41 in the radial direction results in a corresponding movement of the supporting rollers 44, 45 and consequently a pivoting of the supporting levers 38, 39. A movement directed radially outwards in this way causes a pivoting of the supporting levers 38, 39 with the effect of opening the inner walls 31, 32.

The cam discs 42, 43 are equipped with elevations 46, 47 in the region of a receiving station 25 and with further elevations 48, 49 in the region of the transfer station 26. The latter have a smaller radial dimension than the elevations 46, 47, so that in the region of the transfer station there is only a slight opening movement which is sufficient to allow the packs 10, 11 to be shifted in an axisparallel direction free of constraint. In order to execute an opening and closing movement of the pockets 18, 19; 18*a*, 19*a*, etc., the cam discs 42, 43 are moved to and fro in the circumferential direction, specifically through an angle of rotation 50 of 20°. The relative position of the cam discs 42, 43 with the elevations 46 to 49 in relation to the main levers 36, 37 and their tracer rollers 40, 41 is selected so that only the main levers 36, 37 of the pockets 18, 19 are stressed in the region of the receiving station 25 and only those of the pockets 18*c*, 19*c* are stressed in the region of the transfer station. When the transfer turret 17 is stationary, the corresponding rotary movement of the cam discs 42, 43 is, moreover, such that the elevations 46 to 49 are moved past the tracer rollers 40, 41, executing a radially directed stroke.

The levers 36, 39 are mounted on radially outer rotary axles 51, 52. The arrangement is such that both a main lever 37 and a supporting lever 38 of two different adjacent pockets (for example, the pockets 18 and 19*d*) are mounted on a common rotary axle 51. Likewise, the main lever 36 and a supporting lever 39 are mounted on the adjacent rotary axle 52, the two levers being assigned to different "diagonally" adjacent pockets. As a result of this rotary mounting of the levers 36 to 39, the above-described actuation of the two elevations 46, 47 or 48, 49 is possible.

The levers 36 to 39 automatically return to the initial position by means of supporting springs 53 which, in the exemplary embodiment illustrated, are arranged between the adjacent inner walls 31, 32 of the pockets 18, 19, etc. belonging to a pocket unit 20, 21, etc. When the pockets are opened, the supporting springs 53 are subjected to compressive stress.

The rotary axles 51, 52 and the levers 36 to 39 are mounted between two plate-shaped turret discs 54, 55 arranged at a distance from one another. These are connected to one another by means of the rotary axles 51, 52, the rotary axles 51, 52 being received in the turret discs 54, 55 by means of end pivot bearings.

The turret discs 54, 55 are designed as a regular pentagon in conformity with the shape of the transfer turret 17. Two pockets 18, 19, etc. of a pocket unit 20, 21, etc. are located respectively in the region of rectilinear disc edges 56. In this region, The turret discs 54, 55 are connected to one another by means of a plate-shaped pocket bottom 57. The packs, 10, 11 rest against this. The pockets 18, 19, etc. are open in the axial direction at the sides.

Figure 3:
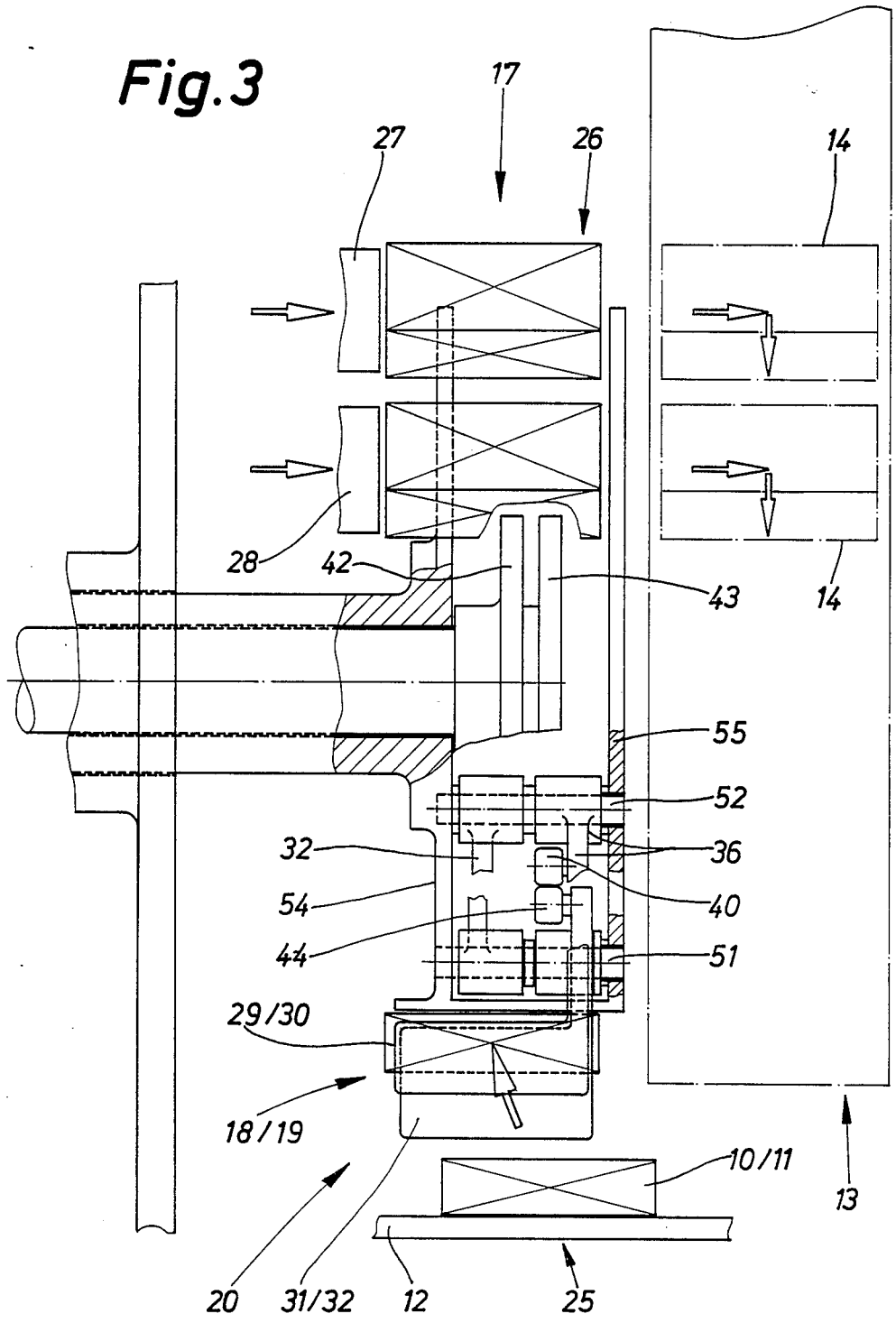
FIG. 3 shows a partially sectional side view of the apparatus according to FIG. 1.
Figure 4:
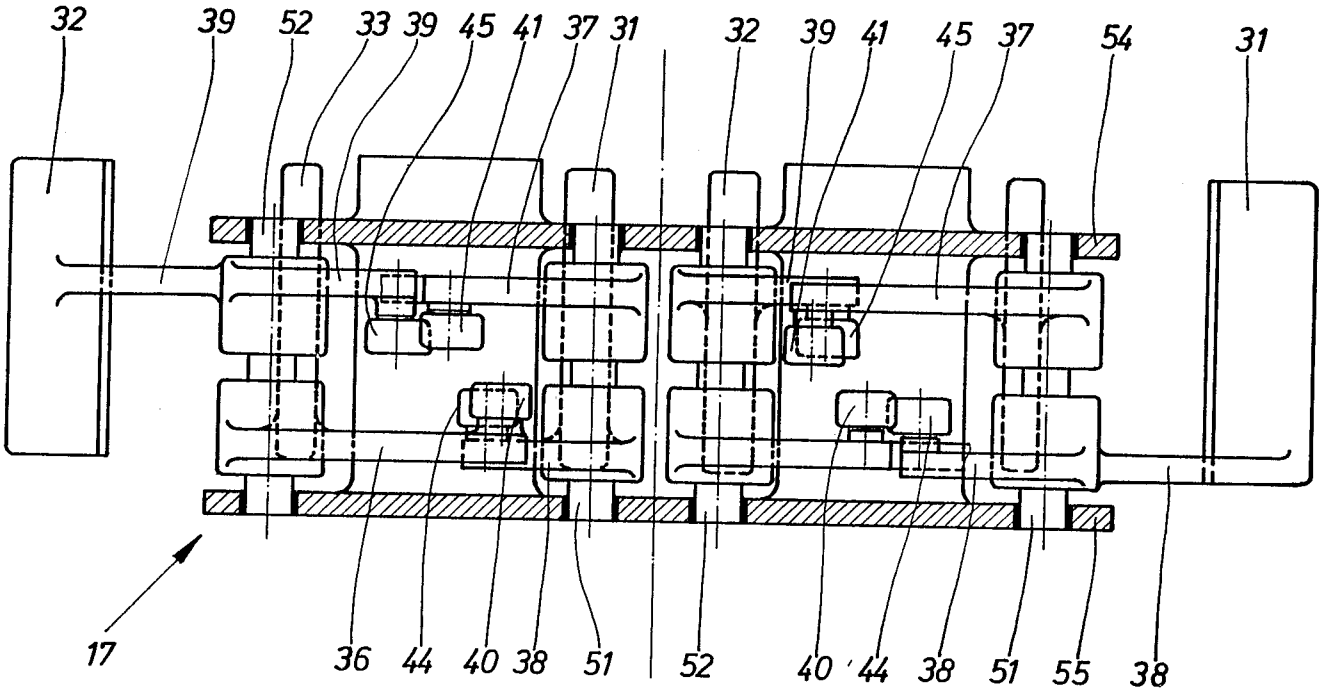
FIG. 4 shows a horizontal section through the transfer turret in the sectional plane IV—IV of FIGS. 1 and 2.

To accommodate the levers 36 to 39 together with the associated parts between the turret discs 54, 55 in an optimum manner, the levers 36 to 39 are mounted on the rotary axles 51, 52 in several, in the present case two, planes offset to one another in the axial direction. The main levers 36, 37 on the one hand and supporting levers 38, 39 on the other hand which are assigned to respective pockets 18, 19, etc. lie in a common plane. In the representation according to FIGS. 1 and 2, the main lever 36 and the supporting lever 38 of the pocket 18 lie in a front plane of the drawing. In contrast to this, the main lever 37 assigned to a pocket 19 and the supporting lever 39 belonging to the same pocket 19 are in a rear set-back plane of the transfer turret 17. The pocket walls connected to the levers 36 to 39, in particular the outer walls 29, 30 and inner walls 31, 32, are respectively aligned centrally with the pockets 18, 19, etc.. Insofar as is predetermined by the mounting plane, the levers 36 to 39 are connected to the pocket walls 29 to 32 eccentrically, that is to say in an offset manner (FIGS. 3 and 4).

What is claimed is:

1. Apparatus for transferring block-shaped packs from a conveying track to a drying turret, and including a transfer turret which has a number of radially outwardly and laterally open pockets for receiving the packs, the pockets possessing transversely moveable, pivotable pocket walls which, for the reception and discharge of packs, are movable away from one another as a result of the supporting of pivoting levers of the pocket walls on a cam disc movable to and fro, said apparatus being characterized in that, in order to receive, convey and transfer two packs (10, 11) simultaneously, the transfer turret (17) has two pockets (18, 19; **18*a*, 19*a*; etc.) of a pocket unit (20, 21, etc.) which are arranged next to one another in one plane, pocket walls (29 to 32) of the pockets being movable simultaneously into an opening or closing position by means of pairs of pivoting levers (36, 37; 38, 39); and in that each pocket (18, 19, etc.) has assigned to it a main lever (36, 37) for actuating an outer wall (29, 30) and a supporting lever (38, 39) for actuating an inner wall (31, 32), the main lever (36, 37) and the supporting lever (38, 39**) being arrange in different planes offset relative to one another in the axial direction.

2. Apparatus according to claim 1, characterized in that the main levers (36, 37) and supporting levers (38, 39) of the same pockets (18, 19, etc.) are arranged in a common plane.

3. Apparatus according to claim 2, characterized in that the main levers (36, 37) and the supporting levers (38, 39) of adjacent pockets (18, 19, etc.) are arranged in offset planes.

4. Apparatus according to claim 3, characterized in that the main lever (36, 37) and the supporting lever (38, 39), respectively, of an adjacent pocket (18, 19, etc.) of another pocket unit (20, 21, etc.) are mounted on a common rotary axle (51, 52).

5. Apparatus according to claim 4, characterized in that the main levers (36, 37) and the supporting levers (38, 39), together with the rotary axles (51, 52), are arranged between two turret discs (54, 55) which are connected to one another by means of the rotary axles (51, 52).

6. Apparatus according to claim 5, characterized in that, at an outer disc edge (56) of the turret disc (54, 55), a pocket bottom (57) connecting the turret discs (54, 55) to one another is arranged, respectively, in the region of each pocket (18, 19, etc.).

7. Apparatus according to claim 5, characterized in that two identically designed and jointly rotatable cam discs (42, 43) located at a distance from one another are arranged between the two turret discs (54, 55).

8. Apparatus for transferring block-shaped packs from a conveying track to a drying turret by means of a transfer turret (17), wherein said transfer turret comprises:

radially outwardly and laterally open pockets (18, 19), each for receiving one pack (10, 11), disposed along the circumference of the transfer turret (17); and pocket walls delimiting each pocket (18, 19), said pocket walls consisting of an outer wall (29, 30) and an inner wall (31, 32) each being disposed on pivotable levers (36, 37; 38, 39), said levers being pivoted in order to open and close said pockets (18, 19); and wherein:

two pockets (18, 19) are each arranged with their pocket bottom (57) on one plane lying side-by-side and forming a pocket unit (20, 21 . . . ), the pocket walls (29, 30; 31, 32) of both pockets of a pocket unit (20, 21 . . . ) being moved together and simultaneously for receiving and delivering one pack (10, 11) each;

oppositely situated inner walls (32, 32) of the pockets of a pocket unit (20, 21 . . . ) are each connected to a supporting lever (38, 39), and outwardly lying outer walls (29, 30) of the same pocket unit (20, 21 . . . ) are each connected to a main lever (36, 37);

free ends of the supporting lever (38, 39) are supported with supporting rollers (40, 45) on tracer rollers (40, 41), said tracer rollers (40, 41) resting against a cam disc (42, 43) and being operable by means of relative rotation;

the supporting levers (38, 39) on one pocket unit (20, 21 . . . ) are pivotably mounted on parallel rotary axles (51, 52); and the main levers (36, 37) of a pocket unit (20) are each mounted rotatably on rotary axles (51, 52) of adjacent pocket units (21, 24).

9. Apparatus according to claim 8, wherein the adjacent inner walls (31, 32) of a pocket unit (20, 21 . . . ) support each other by means of a supporting spring (53).

10. Apparatus according to claim 8, wherein the cam disc is provided with two elevations (46, 47) in the region of a receiving station (25) of the transfer turret (17), said elevations (46, 47) being assigned to the tracer rollers (40, 41) of main levers (36, 37) of the same pocket unit (20, 21 . . . ).

11. Apparatus according to claim 9, wherein the cam disc is provided with two elevations (46, 47) in the region of a receiving station (25) of the transfer turret (17), said elevations (46, 47) being assigned to the tracer rollers (40, 41) of main levers (36, 37) of the same pocket unit (20, 21 . . . ).

12. Apparatus according to claim 8, wherein the main levers (36, 37) and supporting levers (38, 39) of the same pocket (18, 19) are arranged in a common plane and the main levers (36, 37) and support levers (38, 39) of adjacent pockets (18, 19) of the same pocket unit (20, 21 . . . ) are arranged in planes offset in an axial direction.

13. Apparatus according to claim 8, wherein the main levers (36, 37) and supporting levers (38, 39) are arranged with the rotary axles (51, 52) between two turret discs (54, 55), said turret discs (54, 55) being connected by means of said rotary axles (51, 52).

14. Apparatus according to claim 13, wherein at an outer disc edge (56) of each turret disc (54, 55), a pocket bottom (57) connecting the turret discs (54, 55) to one another is arranged in the region of each pocket (18, 19 . . . ).

* * * * *